United States Patent [19]

Schunter

[11] Patent Number: 4,680,826

[45] Date of Patent: Jul. 21, 1987

[54] FLOOR WIPER FRAME

[75] Inventor: Roland Schunter, Lorch-Waldhausen, Fed. Rep. of Germany

[73] Assignee: Floordress Reinigungsgeraete, Lorch-Waldhausen, Fed. Rep. of Germany

[21] Appl. No.: 718,132

[22] Filed: Apr. 1, 1985

[30] Foreign Application Priority Data

Sep. 5, 1984 [DE] Fed. Rep. of Germany ..... 3432685

[51] Int. Cl.[4] ..... A47L 13/258

[52] U.S. Cl. ..... 15/147 R; 15/229 BP

[58] Field of Search ..... 15/147 R, 147 A, 147 B, 15/149, 228, 229 AC, 229 AP, 229 BC, 229 BP

[56] References Cited

U.S. PATENT DOCUMENTS

| | | | |
|---|---|---|---|
| 2,724,851 | 11/1955 | Steiner | 15/229 BP X |
| 2,987,745 | 6/1961 | Ballinger | 15/229 BP |
| 3,082,456 | 3/1963 | Short | 15/229 BP X |
| 3,085,271 | 4/1963 | Janssen | 15/229 BP X |

FOREIGN PATENT DOCUMENTS

| | | | |
|---|---|---|---|
| 1116677 | 2/1956 | France | 15/229 BP |

*Primary Examiner*—Chris K. Moore
*Attorney, Agent, or Firm*—Nelson Littell, Jr.

[57] ABSTRACT

A floor wiper formed from two frame portions which are pivotal with respect to each other, and adapted to be locked by magnetic means, having a pedal disposed on one frame portion, and engaging the other, which pedal is adapted to disengage the magnetic locking means.

12 Claims, 3 Drawing Figures

FLOOR WIPER FRAME

This invention relates to an improvement in a frame for a floor wiper which is formed from two frame portions which are pivotal relatively to each other and which in the operating or stretched position can be arrested by means of a holding magnet fastener.

In a floor wiping device of the aforementioned type the replaceable wiping cloths or mops are fitted to the wiping device or pulled over the wiping device whilst the latter is in the folded or collapsed state, whereupon the wiping device is stretched and held by the holding magnet fastener. When the wiping cloth has been used the wiping device is opened by releasing the holding magnet fastener and brought into the folded position whereupon the wiping cloth or covering can be replaced.

In this type of folding floor wiper frame for replaceable mops can be provided in that replacement of the mops and also locking and unlocking can be carried out without any need for manual contact and in that the construction is extremely simple and, despite its ability to withstand even the roughest working conditions, requires a minimum of material and parts. More particularly, the wiper is essentially produced from plastic parts, preferably with a flat underneath and/or upper surface. In the frame for a floor wiper comprising two frame members designed to be folded towards one another about a pivot pin and to be locked in their open position by means of a locking mechanism, this is achieved in that one frame member has a T-shape and the other frame member a U-shape which makes with the T-shaped member into a substantially rectangular plate and in that pivot pin extends substantially perpendicularly of the longitudinal direction of the arms of the T and the U and in that the locking mechanism contains a permanent magnet clamp.

The magnetic force must be adequate to keep the floor wiping device in the stretched and thus closed position during use even when the device is subjected during operation for example to impacts or other loads. It has been found that for releasing the holding magnet fastener and thus opening the wiping device a relatively large force is necessary which cannot always be applied readily or quickly enough.

OBJECT OF THE INVENTION

An object of the invention is to develop a floor wiping device of the type set forth above so that the holding magnet fastener can be easily released and the wiping device quickly opened without problems.

Another object of the present invention is an improvement in a frame for a floor wiper comprising a flat frame shape equipped with a handle socket which frame shape is formed by two frame portions which are pivotal with respect to each other and adapted to be locked in their fully extended position by means of a holding magnet locking means, the improvement consisting of a pedal disposed on one of said two frame portions having an extension engaging the other of said two frame portions, which pedal is moveable in the direction of separation of said two frame portions whereby said holding magnet locking means is disengaged.

A further object of the present invention is an improvement in a frame for a floor wiper comprising a flat frame shape equipped with a handle socket, which frame is designed to be introduced at its longitudinal ends into the end pockets of a replaceable mop, consisting of two frame members foldable towards one another about a pivot pin extending substantially parallel to the bottom surface of said flat frame shape, one of said two frame members having a T-shape and the other frame member having a U-shape, said T-shape member and said U-shape member being adapted to form a substantially rectangular plate flat frame shape, said pivot pin extending substantially perpendicularly to the longitudinal direction of the arms of the T-shape and the U-shape of said two frame members, the extended arm of said T-shape member abuting the flat part of said U-shape member and said abutting area being provided with a lock means comprising a permanent magnet and counter-plate forming a permanent magnet clamp whereby said two frame members are lockable in the fully extended or stretched position, the improvement consisting essentially of providing a pedal pivotting about a second pivot pin extending substantially parallel to the bottom surface of said flat frame shape extending between the arms of said U-shape frame member, said pedal being disposed to engage the end of the arm of said T-shape frame member and being moveable in the direction of separation of said two frame members thereby releasing said permanent magnet clamp locking means.

These and other objects of the invention will become more apparent as the description thereof pro- ceeds.

DESCRIPTION OF THE INVENTION

The above objects are achieved in on a frame portion of a frame for a floor wiper comprising a flat frame shape equipped with a handle socket, which frame is designed to be introduced at its longitudinal ends into the end pockets of a replaceable mop, consisting of two frame members foldable towards one another about a pivot pin extending substantially parallel to the bottom surface of said flat frame shape, one of said two frame members having a T-shape and the other frame member having a U-shape, said T-shape member and said U-shape member being adapted to form a substantially rectangular plate flat frame shape, said pivot pin extending substantially perpendicularly to the longitudinal direction of the arms of the T-shape and the U-shape of said two frame members, the extended arm of said T-shape member abuting the flat part of said U-shape member and said abutting area being provided with a lock means comprising a permanent magnet and counterplate forming a permanent magnet clamp whereby said two frame members are lockable in the fully extended or stretched position, and a pedal is disposed which engages the other frame portion and is movable in the direction of separation of the two frame portions.

More particularly therefore, the present invention relates to an improvement in frame for a floor wiper comprising a flat frame shape equipped with a handle socket which frame shape is formed by two frame portions which are pivotal with respect to each other and adapted to be locked in their fully extended position by means of a holding magnet locking means, the improvement consisting of a pedal disposed on one of said two frame portions having an extension engaging the other of said two frame portions, which pedal is moveable in the direction of separation of said two frame portions whereby said holding magnet locking means is disengaged.

The frame for a floor wiper involves far less outlay in material and assembly work and, in addition, affords the opportunity of designing the frame members in such a way that, in the fully extended or stretched position, they are substantially flat and uninterrupted, above all over their bottom surface. For this simple reason, even the handling of the wiper in use affords significant advantages over known wipers with bracket-like frame members.

Particular attention is to be paid to the design of the permanent-magnet clamp. This is because the magnetic locking force of the locking mechanism is not determined solely by the magnet or magnet system used, but also by the material to be attracted and the position of the particular magnet relative to the pivoting axis of the wiper frame as a whole. Thus, in the present context, the holding power of magnets, aside from the material used, magnetization, pole interval, dimensions etc., is also determined for the most part by the mass and hence by the weight of the magnet itself.

So far as the use of magnets in the locking mechanism of a folding floor wiper is concerned, it is important to keep the weight and size of the magnets used for locking to a minimum and optimally to utilize the magnetization present in the magnetic mass for firm locking, taking (mechanical) leverage laws into account. Since, in the case of a lever, the product of force times force arm is equal to the product of load times load arm and since the latter product is predetermined by half the weight of the mop and the weight of the load arm, the mass of the magnet used may be kept below any particular value required providing the magnet is attached to the free end of as long a force arm as possible. If the ratio of force arm to load arm is 1:2 for example, a magnetic holding force of 2 kg is sufficient to establish an equilibrium where the frame and mop weighs 1 kg and the load arm weighs 0.5 kg. In such a case, if the magnet used is a flat gripping magnet having a holding force of 3 kg, much greater magnetic forces are available to compensate the pulling and pushing forces acting on the lock in the operation of the mop.

Where magnetic clamps are used as the locking mechanism in a frame for a floor wiper, it is also important to ensure that magnetic short circuits are avoided. Accordingly, all parts adjoining the locking magnet and/or its counter-plate must consist of nonmagnetizable material, for example chrome-nickel steel, plastic or the like. Thus, where the frame members of the floor wiper are made of plastic and where a steel pivot pin is used, arrangement of the magnetic lock in the zone adjoining one of the longitudinal ends of the frame is preferred not only because of the more favorable leverage, but also because of the greater distance from the pin.

In the above construction, advantageously, the pedal of the present invention, designed to separate the magnet from its counter-plate is pivotally movable on a shaft running substantially parallel to the bottom surface of the frame. The shaft is mounted in the one frame portion.

The pivot angle of the pedal is conveniently limited by means of a stop or by striking the one frame portion and can for example be a few millimeters. Preferably, the pedal is constructed in the form of a 2-armed lever whose one end is for example actuable by foot while its other end is constructed in the form of an edge which extends substantially parallel to its pivot axis and which engages in a gap between the two frame portions adjacent the holding magnet fastener.

An example of embodiment of the invention will be explained hereinafter with the aid of the drawings, wherein.

Figure 2:
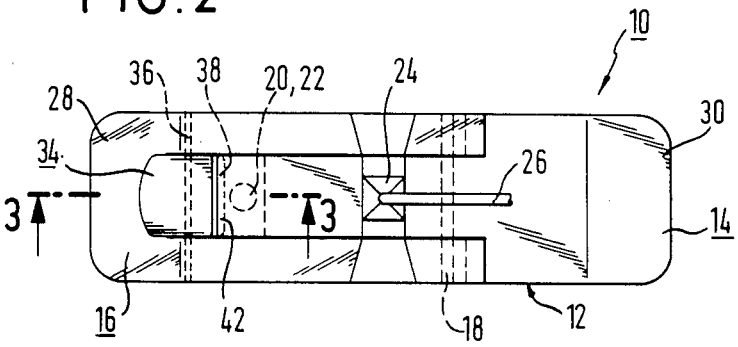
FIG. 2 shows the floor wiping device of FIG. 1 in plan view.

The floor wiping device 10 consists of a frame 12, for example of plastic, which is formed from a T-shaped frame portion 14 and a U-shaped frame portion 16 which are pivotally connected together by a shaft 18. As shown by FIG. 2 the axis 18 extends transversely of the longitudinal axis of the frame through the two frame portions 14 and 16.

The two frame members 14 and 16 which are preferably made of a plastic resistant to the usual cleaners are shaped in such a way that they fit into one another and, in the fully extended or stretched position, together form a substantially flat rectangular surface. In practice, the frame members 14 and 16 may be cut out for example from a 14 mm thick plastic panel in such a way that, together, they cover an area being 85 mm parallel to the pivot pin 18 and 560 mm perpendicularly of the pivot pin 18.

Figure 1:
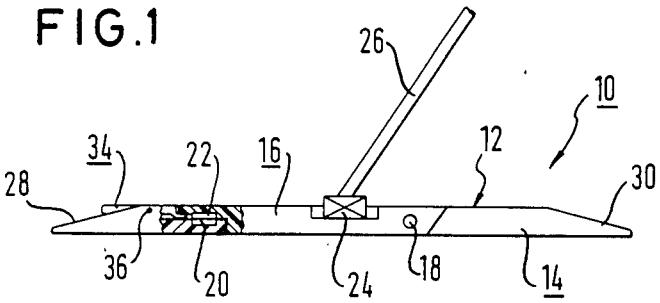
FIG. 1 is a side elevation of a floor wiping device.
Figure 3:
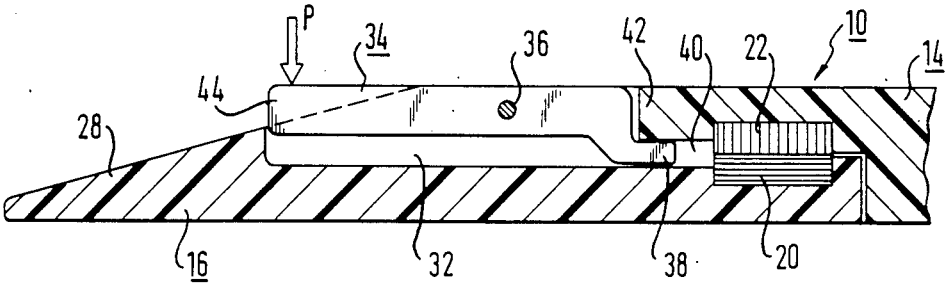
FIG. 3 shows a longitudinal section of the floor wiping device along the line 3—3 of FIG. 2.

A magnet 20 is disposed on the frame part 16 and a magnet armature or counter-plate 22 on the frame portion 14, as apparent in particular from FIG. 3. In the stretched or extended position, i.e. the working position as illustrated in FIG. 1, the counter plate 22 bears on the magnet 20 and the two frame portions 14 and 16 are thereby held in extended position as shown by the holding magnet fastener formed by the two members 20 and 22.

The floor wiping device is further provided with a cardan-like handle holder 24 with the handle 26 disposed thereon.

To start operation the two frame portions 14 and 16 are pivoted about the shaft 18 and the bevelled ends 28 and 30 inserted into a mop cover provided with corresponding pockets, whereupon the two frame halves 14 and 16 are again brought into the extended position and fixed in said position by the holding magnet fastener 20, 22.

For opening the wiping device, i.e. for folding the two frame portions 14, 16, the holding magnet fastener must be released, i.e. the counter plate 22 must be separated from the magnet 20 by overcoming the magnetic force. For this purpose a pedal 34 is provided which is disposed in a recess 32 of the frame portion 16. The pedal 34 is pivotal about a shaft 36 which as shown in particular in FIG. 2 extends transversely of the longitudinal axis of the frame 12 and is held in the frame portion 16. As shown in FIG. 3 the pedal 34 is provided at its end facing the holding magnet fastener 20, 22 with a lip or edge 38 which engages beneath a nose 42 of the frame portion 14 in which the counter plate 22 is mounted. The edge 38 extends into a gap 40 between the frame portions 14 and 16 adjacent the holding magnet fastener.

If a force is applied in the direction of the arrow P on the pedal 34 at is one end 44 the pedal 34 pivots anticlockwise about the axis 36, a force thereby being exerted by the edge 38 of the pedal 34 on the nose 42 of the frame portion 14 in the opening direction of the frame portions 14, 16 and as a result by overcoming the holding force of the magnet 20 the counter plate 22 is freed from the latter. The two frame portions 14, 16 can then easily be brought into the fully folded position by pulling the handle 26.

The pivot angle of the pedal 34 is limited so that the travel of the edge 38 is a few millimeters, e.g. 2–4 mm. To limit the pivot angle of the pedal 34 a special stop can be provided but conveniently the bottom of the recess 32 forms the stop for the end 44 of the pedal 34.

The preceding is a non-limiting embodiment of the frame for a floor wiper of the invention. It is to be understood, however, that other expedients known to those skilled in the art or disclosed herein may be employed without departing from the spirit of the invention or the scope of the appended Claims.

REFERENCE NUMBERS INDEX

10=Folding floor wiper
12=Folding frame
14=T-shaped frame member
16=U-shaped frame member
18=Pivot pin shaft
20=Permanent magnet
22=Counter-plate
24=Handle holder
26=Handle
28=Bevelled longitudinal end of the U frame
30=Bevelled longitudinal end of the T frame
32=Recess in the U frame
34=Pedal
36=Pedal pivot pin shaft
38=Pedal lip
40=Gap
42=Nose of the T frame
44=End of pedal opposite pedal lip

I claim:

1. In a frame for a floor wiper comprising a flat frame shape equipped with a handle socket which frame shape is formed by two frame portions which are pivotal with respect to each other and adapted to be locked in their fully extended position by means of a holding magnet locking means, the improvement consisting of a pedal disposed on one of said two frame portions having an extension engaging the other of said two frame portions, which pedal is moveable in the direction of separation of said two frame portions whereby said holding magnet locking means is disengaged.

2. The floor wiper frame of claim 1 wherein said pedal is pivotally mounted on shaft which extends transversely of the longitudinal direction of said frame shape substantially parallel to the bottom thereof.

3. The floor wiper frame of claim 2 wherein the pivot angle of said pedal is limited by means of a stop.

4. The floor wiper of claim 3 wherein said pedal is in the form of a two-armed lever whose one end is actuable by foot.

5. The floor wiper of claim 4 wherein the other end of said two-armed lever is in the form of an edge which extends substantially parallel to the axis of said shaft and engages beneath a nose of said other of said two frame portions.

6. The floor wiper frame of claim 2 wherein said pedal is in the form of a two-armed lever whose one end is actuable by foot.

7. The floor wiper of claim 6 wherein the other end of said two-armed lever is in the form of an edge which extends substantially parallel to the axis of said shaft and engages beneath a nose of said other of said two frame portions.

8. The floor wiper frame of claim 1 wherein said pedal is in the form of a two-armed lever whose one end is actuable by foot.

9. In a frame for a floor wiper comprising a flat frame shape equipped with a handle socket, which frame is designed to be introduced at its longitudinal ends into the end pockets of a replaceable mop, consisting of two frame members foldable towards one another about a pivot pin extending substantially parallel to the bottom surface of said flat frame shape, one of said two frame members having a T-shape and the other frame member having a U-shape, said T-shape member and said U-shape member being adapted to form a substantially rectangular plate flat frame shape, said pivot pin extending substantially perpendicularly to the longitudinal direction of the arms of the T-shape and the U-shape of said two frame members, the extended arm of said T-shape member abutting the flat part of said U-shape member and said abutting area being provided with a lock means comprising a permanent magnet and counter-plate forming a permanent magnet clamp whereby said two frame members are lockable in the fully extended or stretched position, the improvement consisting essentially of providing a pedal pivotting about a second pivot pin extending substantially parallel to the bottom surface of said flat frame shape extending between the arms of said U-shape frame member, said pedal being disposed to engage the end of the arm of said T-shape frame member and being moveable in the direction of separation of said two frame members thereby releasing said permanent magnet clamp locking means.

10. The floor wiper frame of claim 9 wherein the pivot angle of said pedal is limited by means of a stop.

11. The floor wiper frame of claim 9 where said pedal is in the form of a two-armed lever whose one end is actuable by foot.

12. The floor wiper frame of claim 11 wherein the other end of said two-armed lever is in the form of an edge which extends substantially parallel to the axis of said shaft and engages beneath a nose of said other of said two frame portions.

* * * * *